US008967890B2

(12) United States Patent
Hoshino

(10) Patent No.: US 8,967,890 B2
(45) Date of Patent: Mar. 3, 2015

(54) CONTINUOUS SHEET RECORDING APPARATUS AND METHOD OF CONTROLLING SORTER IN RESPONSE TO CONVEYANCE FAILURE

(75) Inventor: Ken Hoshino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 447 days.

(21) Appl. No.: 12/960,412

(22) Filed: Dec. 3, 2010

(65) Prior Publication Data

US 2012/0051823 A1 Mar. 1, 2012

(30) Foreign Application Priority Data

Aug. 31, 2010 (JP) ..... 2010-194496

(51) Int. Cl.

| | |
|---|---|
| ***B41J 29/38*** | (2006.01) |
| ***B41J 15/04*** | (2006.01) |
| ***B65H 31/24*** | (2006.01) |
| ***B41J 11/70*** | (2006.01) |
| ***B65H 29/62*** | (2006.01) |
| ***B41J 13/00*** | (2006.01) |

(52) U.S. Cl.

CPC *B41J 11/70* (2013.01); *B41J 29/38* (2013.01); *B65H 29/62* (2013.01); *B41J 13/0036* (2013.01); *B41J 15/04* (2013.01)

USPC ..... 400/76; 347/104; 347/19; 271/279; 271/298

(58) Field of Classification Search

USPC ..... 400/76; 347/104; 399/20, 19; 271/279, 271/298

See application file for complete search history.

(56) References Cited

U.S. PATENT DOCUMENTS

| | | | | |
|---|---|---|---|---|
| 7,334,859 | B2 * | 2/2008 | Kojima | 347/19 |
| 2001/0052913 | A1 * | 12/2001 | Matsumoto et al. | 347/19 |
| 2003/0015564 | A1 * | 1/2003 | Crowley et al. | 226/31 |
| 2003/0235328 | A1 * | 12/2003 | Nakamura et al. | 382/112 |
| 2007/0146755 | A1 * | 6/2007 | Mindler et al. | 358/1.12 |
| 2007/0189789 | A1 * | 8/2007 | Suzuki | 399/49 |
| 2009/0041485 | A1 * | 2/2009 | Shoji et al. | 399/43 |

FOREIGN PATENT DOCUMENTS

| | | | | |
|---|---|---|---|---|
| JP | 63315465 | A * | 12/1988 | B65H 43/00 |
| JP | 2001-347488 | A | 12/2001 | |
| JP | 2001341294 | A * | 12/2001 | B41J 2/01 |
| JP | 2008080657 | A * | 4/2008 | B41J 15/16 |

* cited by examiner

*Primary Examiner* — Daniel J Colilla
(74) *Attorney, Agent, or Firm* — Canon USA, Inc., IP Division

(57) ABSTRACT

A recording apparatus includes a conveying unit, recording processing unit, recording detection unit provided downstream of the recording processing unit to check plural maintenance patterns recorded on a continuous sheet, cutter unit, plural discharge units to selectively receive cut sheets, discharge unit changeover unit to select one discharge unit to receive a cut sheet, conveyance failure detection unit, and control unit. The control unit controls the discharge unit changeover unit such that, when a continuous sheet conveyance failure is detected upstream of a position where the cutter is, and a maintenance pattern previously checked is present downstream of the cutter when the conveyance failure is detected, a present sheet unit between the maintenance pattern and the cutter position is discharged to a second discharge unit. The second discharge unit is different from a first discharge unit used for a sheet unit other than the present sheet unit.

23 Claims, 8 Drawing Sheets

FIG.6

| TABLE NUMBER | TYPE OF RECORDING PATTERN | NUMBER OF RECORDING LINE | SORTING DESTINATION | RECORDING CONDITION |
|---|---|---|---|---|
| 1 | SPACE | 2400 | TRASH BOX | DETERMINED |
| 2 | MAINTENANCE | 7200 | TRASH BOX | DETERMINED |
| 3 | SPACE | 2400 | TRASH BOX | DETERMINED |
| 4 | NON-EJECTION MONITORING | 4800 | TRASH BOX | DETERMINED |
| 5 | PRELIMINARY EJECTION | 1000 | TRASH BOX | DETERMINED |
| 6 | CUT MARK | 1000 | TRASH BOX | DETERMINED |
| 7 | PRELIMINARY EJECTION | 1000 | TRASH BOX | DETERMINED |
| 8 | IMAGE 1 | 4800 | TRAY 1 | DETERMINED |
| ⋮ | ⋮ | ⋮ | ⋮ | ⋮ |
| 20 | CUT MARK | 1000 | TRASH BOX | DETERMINED |
| 21 | IMAGE 7 | 4800 | TRAY 1 | DETERMINED |
| 22 | CUT MARK | 1000 | TRASH BOX | DETERMINED |
| 23 | NON-EJECTION MONITORING | 4800 | TRASH BOX | DETERMINED |
| 24 | PRELIMINARY EJECTION | 1000 | TRASH BOX | UNDETERMINED |
| 25 | IMAGE 8 | 4800 | TRAY 2 | UNDETERMINED |
| ⋮ | ⋮ | ⋮ | ⋮ | ⋮ |
| 38 | CUT MARK | 1000 | TRASH BOX | UNDETERMINED |
| 39 | IMAGE 14 | 4800 | TRAY 2 | UNDETERMINED |
| 40 | CUT MARK | 1000 | TRASH BOX | UNDETERMINED |
| 41 | NON-EJECTION MONITORING | 4800 | TRASH BOX | UNDETERMINED |
| 42 | PRELIMINARY EJECTION | 1000 | TRASH BOX | UNDETERMINED |
| 43 | IMAGE 15 | 4800 | TRAY 1 | UNDETERMINED |
| ⋮ | ⋮ | ⋮ | ⋮ | |

PRINT COMMAND TABLE

FIG.8

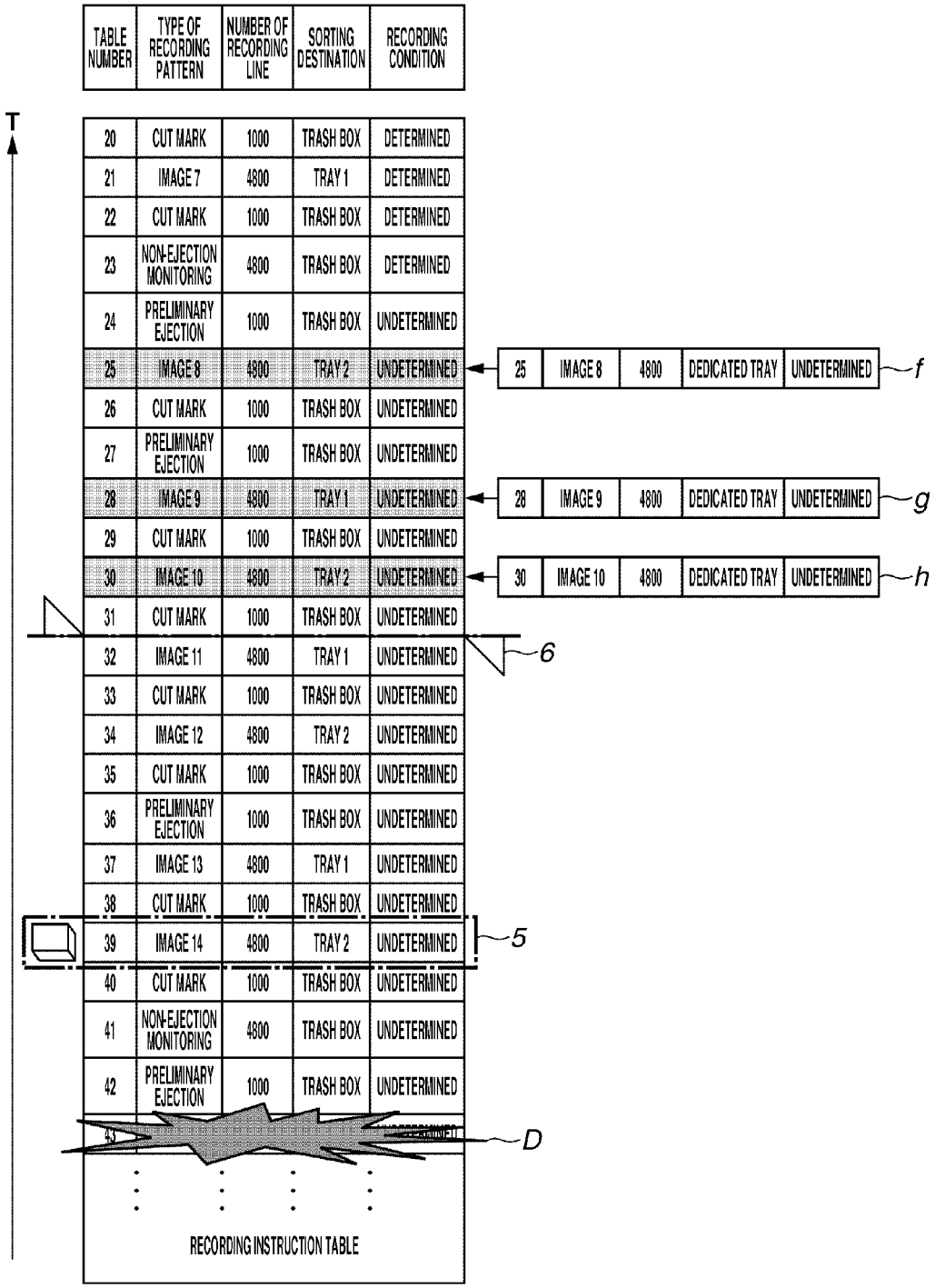

| TABLE NUMBER | TYPE OF RECORDING PATTERN | NUMBER OF RECORDING LINE | SORTING DESTINATION | RECORDING CONDITION |
|---|---|---|---|---|
| 20 | CUT MARK | 1000 | TRASH BOX | DETERMINED |
| 21 | IMAGE 7 | 4800 | TRAY 1 | DETERMINED |
| 22 | CUT MARK | 1000 | TRASH BOX | DETERMINED |
| 23 | NON-EJECTION MONITORING | 4800 | TRASH BOX | DETERMINED |
| 24 | PRELIMINARY EJECTION | 1000 | TRASH BOX | UNDETERMINED |
| 25 | IMAGE 8 | 4800 | TRAY 2 | UNDETERMINED |
| 26 | CUT MARK | 1000 | TRASH BOX | UNDETERMINED |
| 27 | PRELIMINARY EJECTION | 1000 | TRASH BOX | UNDETERMINED |
| 28 | IMAGE 9 | 4800 | TRAY 1 | UNDETERMINED |
| 29 | CUT MARK | 1000 | TRASH BOX | UNDETERMINED |
| 30 | IMAGE 10 | 4800 | TRAY 2 | UNDETERMINED |
| 31 | CUT MARK | 1000 | TRASH BOX | UNDETERMINED |
| 32 | IMAGE 11 | 4800 | TRAY 1 | UNDETERMINED |
| 33 | CUT MARK | 1000 | TRASH BOX | UNDETERMINED |
| 34 | IMAGE 12 | 4800 | TRAY 2 | UNDETERMINED |
| 35 | CUT MARK | 1000 | TRASH BOX | UNDETERMINED |
| 36 | PRELIMINARY EJECTION | 1000 | TRASH BOX | UNDETERMINED |
| 37 | IMAGE 13 | 4800 | TRAY 1 | UNDETERMINED |
| 38 | CUT MARK | 1000 | TRASH BOX | UNDETERMINED |
| 39 | IMAGE 14 | 4800 | TRAY 2 | UNDETERMINED |
| 40 | CUT MARK | 1000 | TRASH BOX | UNDETERMINED |
| 41 | NON-EJECTION MONITORING | 4800 | TRASH BOX | UNDETERMINED |
| 42 | PRELIMINARY EJECTION | 1000 | TRASH BOX | UNDETERMINED |
| 43 | | | | UNDETERMINED |
| ⋮ | ⋮ | ⋮ | ⋮ | ⋮ |

RECORDING INSTRUCTION TABLE

| | | | | |
|---|---|---|---|---|
| 25 | IMAGE 8 | 4800 | DEDICATED TRAY | UNDETERMINED |
| 28 | IMAGE 9 | 4800 | DEDICATED TRAY | UNDETERMINED |
| 30 | IMAGE 10 | 4800 | DEDICATED TRAY | UNDETERMINED |

CONTINUOUS SHEET RECORDING APPARATUS AND METHOD OF CONTROLLING SORTER IN RESPONSE TO CONVEYANCE FAILURE

BACKGROUND OF THE INVENTION

1. Field of the Invention

The present invention relates to a recording apparatus that ejects liquid to record a maintenance pattern on a recording medium, and checks the printed condition of the maintenance pattern to detect an ejection failure of the liquid.

2. Description of the Related Art

In a recording apparatus such as an ink-jet printing apparatus, for example, an ejection failure of ink sometimes occurs due to a clogging of a nozzle that ejects ink or due to an inclusion of air bubbles in a path for supplying ink.

Japanese Patent Application Laid-Open No. 2001-347488 discusses a recording apparatus that employs a continuous sheet rolled up as a recording medium. According to the technique discussed in Japanese Patent Application Laid-Open No. 2001-347488, ink is ejected from a nozzle to an optional position of a sheet to record a predetermined image or a maintenance pattern during the continuous printing operation in the continuous sheet. A nozzle that has an ejection failure is detected by checking the recording state of the maintenance pattern. This result is fed back to maintain the best print quality.

Japanese Patent Application Laid-Open No. 2001-347488 discusses that the recording state of the maintenance pattern is checked, and this result is fed back to the printing operation, but does not describe how to handle a cut sheet having an image recorded thereon.

SUMMARY OF THE INVENTION

The present invention is directed to a recording apparatus that checks a recording state of a maintenance pattern recorded onto a sheet, and reflects the result on handling of a cut sheet having an recorded image thereon.

Further, the recording apparatus can discharge a sheet unit (cut sheet) on which an image whose recording state is undetermined is recorded, in distinction from a cut sheet on which an image whose recording state is determined, thereby being capable of preventing the mixing of these sheets.

According to an aspect of the present invention, a recording apparatus includes a conveying unit configured to convey a continuous sheet, a recording processing unit configured to eject liquid to the continuous sheet to record an image and plural maintenance patterns, a recording detection unit provided at the downstream side from the recording processing unit in the conveying direction of the continuous sheet and configured to check the maintenance patterns recorded on the continuous sheet, a cutter unit provided at the downstream side from the recording processing unit in the conveying direction and configured to cut the continuous sheet into respective sheet units to form a cut sheet, plural discharge units configured to discharge the cut sheet, a discharge unit changeover unit configured to change the plural discharge units such that the cut sheet is discharged onto any one of the plural discharge units, and a detection unit configured to detect a conveyance failure of the continuous sheet, the recording apparatus further including a control unit configured to control the sorter unit such that, when the conveyance failure of the continuous sheet is detected by the detection unit at the upstream side from the position where the cutter is provided, and the previously checked maintenance pattern by the recording detection unit is present at the downstream side from the cutter at the point of detecting the conveyance failure, the sheet unit present between the maintenance pattern and the position of the cutter is discharged onto the discharge unit different from that for another sheet unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is a schematic view for describing the state in which a unit image and a maintenance pattern are sequentially recorded in a predetermined order according to the recording instruction table.

FIG. 8 is a view for describing how the table structure of the recording instruction table is updated after the changing process of the sorting destination of the undetermined image.

DESCRIPTION OF THE EMBODIMENTS

Various exemplary embodiments, features, and aspects of the invention will be described in detail below with reference to the drawings.

In the exemplary embodiment below, a recording apparatus that ejects ink onto a recording medium to perform a recording operation with the use of an ink jet system will be described as one example. However, the present invention is applicable to a general recording apparatus that performs a recording operation onto a continuous sheet, and discharges the continuous sheet as a cut sheet. Examples of the recording apparatus described above include various apparatuses such as a printer, a printer peripheral machine, a copying machine, a facsimile device, and a manufacturing apparatus for various devices.

In the present specification, the continuous sheet means a sheet in which plural sheet units (e.g., a sheet for one page), each of which should finally be cut and separated to be one cut sheet, are continuous in the conveying direction. Accordingly, even a sheet that is obtained by cutting a part of a long-sized continuous sheet is referred to as a continuous sheet, if it includes sheet units for plural pages.

In the present specification, even if plural small images (including characters and symbols) and space are coexistent in a region of one sheet unit, the images included in one sheet unit are collectively referred to as a unit image. Specifically, when the recording operation is sequentially performed (an image is sequentially formed) on plural sheet units of a continuous sheet, the unit image means the whole image formed on one print unit. The unit image may merely be referred to as an image, below. The length of the unit sheet is different depending on the size of the unit image to be printed. For example, in a photograph of an L-size, the length of the unit sheet in the conveying direction is 135 mm, and in A4 size, the length in the conveying direction is 297 mm.

Figure 1:
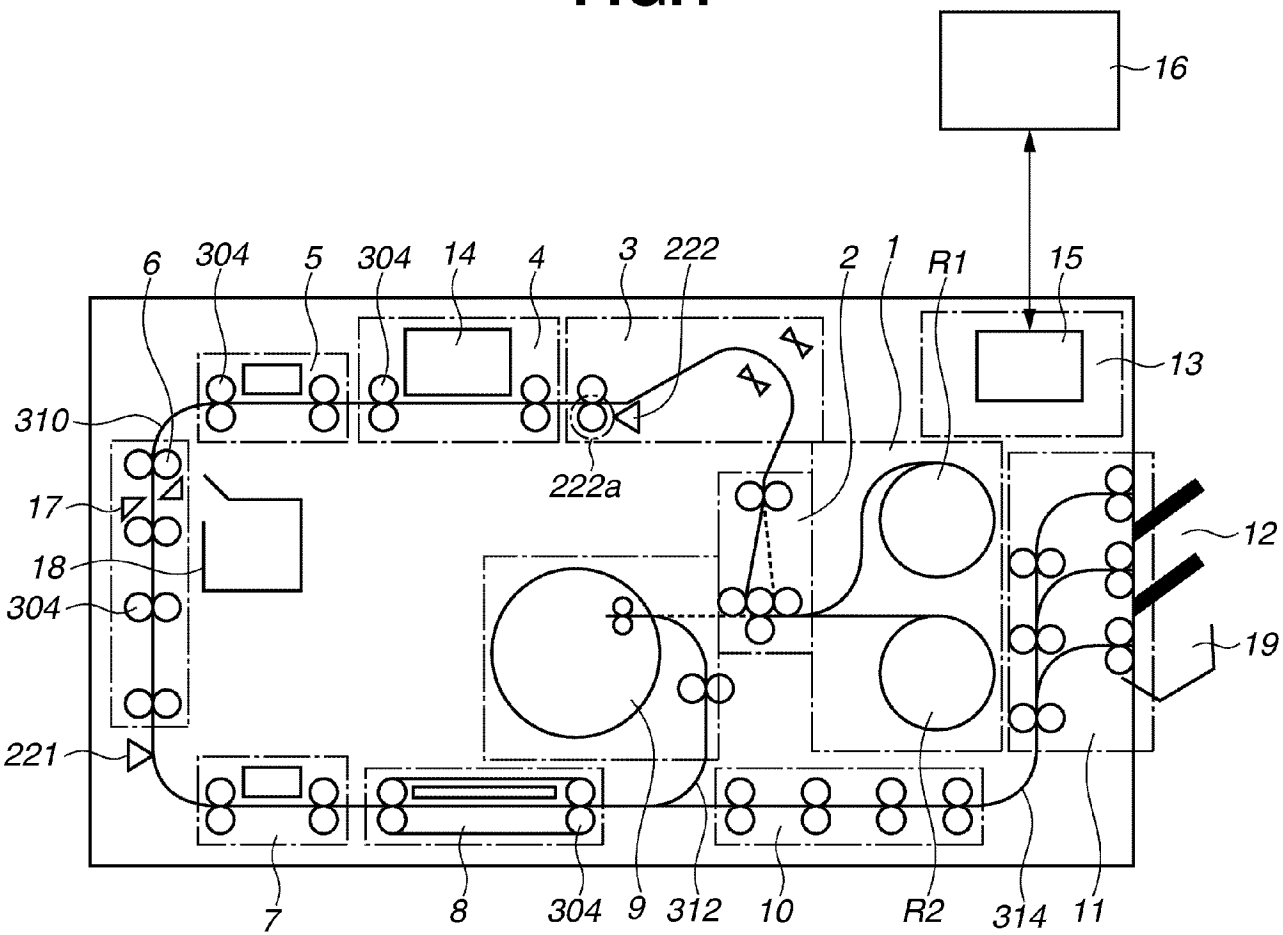
FIG. 1 is a schematic view illustrating an internal configuration of a recording apparatus.

FIG. 1 is a schematic sectional view illustrating an internal configuration of a recording apparatus. In the present exemplary embodiment, a line printer that can perform both one-sided printing and two-sided printing will be described as one example. This line printer is suitable for performing a recording operation on a large number of sheets in a photographic laboratory, for example. Specifically, the recording apparatus in the present exemplary embodiment can perform a recording operation on both surfaces, which are a front surface (first surface) and a back surface (a second surface at the rear of the first surface), of a rolled sheet.

The recording apparatus includes various units such as a sheet supply unit 1, a de-curl unit 2, a skew correction unit 3, a recording processing unit 4, a detection unit (recording detection unit) 5, a cutter unit 6, an information recording unit 7, a drying unit 8, a reversing unit 9, a discharge conveying unit 10, a sorter unit 11, a discharge unit 12, and a control unit 13. The discharge unit 12 is a unit that performs a discharging process. A sheet is conveyed by a conveyance mechanism 304 including a pair of rollers and a belt along a conveying path indicated by a solid line in the figure, and subject to respective processes at the respective units.

In the present specification, the side close to the sheet supply unit 1 for feeding a sheet is referred to as "upstream side", while the side close to the discharge unit 12 for discharging the sheet is referred to as "downstream side", on the sheet conveyance path.

The sheet supply unit 1 is a unit that holds and feeds a rolled continuous sheet. The sheet supply unit 1 can accommodate two rolls R1 and R2 holding the sheet, and selectively feed the sheet from the rolls R1 and R2. A number of the rolls R1 and R2 that can be accommodated in the sheet supply unit 1 is not limited to two, but one or three and more rolls may be accommodated.

In the present exemplary embodiment, the rolled continuous sheet is used as the recording medium. However, the recording medium is not limited to the rolled one, so long as it is a continuous sheet. For example, the recording medium may be a continuous sheet having a perforation for every sheet unit. In this case, the recording medium can be stacked being folded at each perforation, and with this state, accommodated in the sheet supply unit 1.

The de-curl unit 2 reduces a curl (warpage) of the sheet fed from the sheet supply unit 1. The de-curl unit 2 applies warpage in the direction opposite to the direction of the curl on the continuous sheet using two pinch rollers for one drive roller, whereby the sheet passes being curved. As a result, the de-curl force is exerted on the continuous sheet, whereby the curl on the continuous sheet can be reduced.

The skew correction unit 3 is a unit that corrects a skew (which means the sheet travels skewed to the correct traveling direction) of the sheet passing through the de-curl unit 2. A side edge of the sheet along the conveying direction, preferably one side edge, is pressed against an unillustrated guide member to correct the skew of the continuous sheet. A loop is formed on the conveyed sheet at the skew correction unit 3.

The recording processing unit 4 ejects ink as liquid to the conveyed continuous sheet from a head 14 to perform recording (formation of an image) onto the sheet. Specifically, the recording processing unit 4 performs a predetermined process to perform the recording onto the continuous sheet. The recording processing unit 4 preferably includes plural conveyance rollers (conveyance mechanism) 304 for conveying the sheet. The recording processing unit 4 not only records an image based on image information transmitted from a host but also records a maintenance pattern or a below-described cut mark onto the continuous sheet at a predetermined frequency.

In one preferable example, the head 14 includes a line-type print head in which a nozzle array of an ink jet system is formed in a range covering the maximum width (the maximum width in the direction orthogonal to the conveying direction) of the sheet to be used. Plural heads 14 are preferably arranged along the conveying direction to be parallel to each other. In the present exemplary embodiment, seven heads 14 are provided, each of which corresponds to cyan (C), magenta (M), yellow (Y), light cyan (LC), light magenta (LM), gray (G), and black (K), and ejects corresponding ink. The type of the ink and the number of the head 14 are not limited to seven. The ink of each color is stored in an individual ink tank, and supplied to the head 14 from each ink tank through an ink tube.

The ink jet system can employ an energy generating element that generates energy for ejecting ink, such as a system using heat generating element, a system using a piezoelectric element, a system using an electrostatic element, and a system using a Micro Electro Mechanical System (MEMS) element.

The detection unit 5 is a unit for checking the maintenance pattern recorded onto the sheet at the recording processing unit 4 to determine whether the image is correctly recorded. The detection unit 5 is provided at the downstream side from the recording processing unit 4 in the sheet conveying direction. The maintenance pattern is an image pattern used for checking whether the recording operation is normally performed. When the maintenance pattern is checked, a failure of a nozzle ejecting the liquid at the head is detected, whereby whether the image recorded on the continuous sheet is satisfactory can be determined. As an example, the detection unit 5 optically reads the maintenance pattern by a scanner to check the ejecting state of the head 14, the conveyed state of the sheet, and the image position, to determine whether the image is correctly recorded. A Charge Coupled Device (CCD) image sensor or a Complementary Metal Oxide Semiconductor (CMOS) image sensor can be used as the scanner.

If the result of checking the maintenance pattern by the detection unit 5 is satisfactory, it can be determined that at least the image recorded on the sheet unit before the recording of the maintenance pattern is satisfactory. Alternatively, if the preceding maintenance pattern is also satisfactory, it can be determined that the image recorded on the sheet unit between the recording of the preceding maintenance pattern and the recording of the current maintenance pattern is satisfactory. Further, it may be estimated that the images recorded after the recording of the maintenance pattern in a predetermined page are satisfactory.

The cutter unit 6 is a unit provided with a cutter 17 that cuts the sheet to separate the continuous sheet in a predetermined length after the recording operation. The cutter unit 6 is provided at the downstream side from the detection unit 5 in the sheet conveying direction. Further, the cutter unit 6 preferably includes an unillustrated cut mark sensor for optically detecting the cut mark recorded onto the continuous sheet and plural conveyance rollers (conveyance mechanism) for conveying the sheet toward the downstream side.

A trash box 18 is provided in the vicinity of the cutter unit 6. The trash box 18 accommodates small sheet pieces cut out at the cutter unit 6 and discharged as trash. The cutter unit 6 is provided with a sorting mechanism that sorts the cut sheets, cut and separated from the continuous sheet, into the trash box 18 or into the original conveyance path.

The information recording unit 7 is a unit that records information (specific information) such as a serial number of date in a non-print region (blank space region) of the cut and separated sheet. The information is recorded by printing characters or codes by an ink jet system or a thermal transfer system.

The drying unit 8 applies heat to the sheet, which has the image recorded thereon at the recording processing unit 4, to dry the deposited ink in a short period. In the drying unit 8, a hot air is applied to the conveying sheet from at least the rear surface to dry the ink. The drying method is not limited to the method of applying hot air, but a method of irradiating the surface of the sheet with an electromagnetic wave (ultraviolet ray or infrared ray) may be employed.

The conveyance path for recording an image and performing related successive processes, i.e., the conveyance path for performing the processes up to the drying process at the drying unit 8 in the present exemplary embodiment, is referred to as a first path 310. Specifically, in the present exemplary embodiment, the first path 310 is the sheet conveyance path from the sheet supply unit 1 to the drying unit 8. The end portion of the first path 310 at the downstream side is branched to a second path 312 and a third path 314. The reversing unit 9 is provided halfway on the second path 312. The second path 312 joins the first path 310 at the upstream side of the recording processing unit 4, and constitutes a loop path with the first path 310. In the present exemplary embodiment, the first path shows a U-shape from the recording processing unit 4 to the drying unit 8, wherein the periphery of the cutter unit 6 is located on the U-turn shape.

The second path 312 is a path used for performing a recording on both surfaces of the sheet. The reversing unit 9 is a unit that temporarily takes up the continuous sheet, to which the recording operation on the front surface has been completed, to reverse the sheet during the two-sided recording (two-sided printing). The reversing unit 9 is provided on the path (loop path) from the drying unit 8 to the recording processing unit 4 via the de-curl unit 2 to feed again the sheet passing through the drying unit 8, to the recording processing unit 4.

The reversing unit 9 includes a take-up rotating member (drum) that rotates to take up the sheet. The continuous sheet to which the recording on the front surface is completed, and which has the continuous plural sheet units, is temporarily taken up by the take-up rotating member. After the take-up is completed, the take-up rotating member inversely rotates, whereby the sheet, which has already been taken up, is fed in the opposite direction to the take-up direction to be supplied to the de-curl unit 2, and then, conveyed to the recording processing unit 4.

This sheet is sent to the first path 310 being reversed with the front surface on which the recording is performed. Therefore, the recording operation can be performed on the back surface at the recording processing unit 4. If the sheet supply unit 1 is referred to as a first sheet supply unit, the reversing unit 9 can be referred to as a second sheet supply unit. The specific operation of the two-sided recording (two-sided printing) will be described below.

The discharge conveying unit 10 is provided on the third path 314, and it is a unit that conveys the cut sheet, which is cut at the cutter unit 6 and dried at the drying unit 8, and transfers the cut sheet to the sorter unit 11. The discharge conveying unit 10 is provided as a path different from the second path 312 provided with the reversing unit 9.

A path changeover mechanism (not illustrated) is provided at the branch position (sometimes referred to as "discharge branch position") of the path to selectively guide the sheet, passing through the first path 310, to either one of the second path 312 and the third path 314. The path changeover mechanism has an unillustrated movable flapper, which changes the path between the state in which the first path 310 and the second path 312 communicate with each other and the state in which the first path 310 and the third path 314 communicate with each other.

The discharge units 12 and 19 are provided at the terminal of the third path 314. The sorter unit 11 serving as a changeover unit for discharge unit sorts the plural cut sheets, on which the recording operation has already been performed, into each group as required. The sorted cut sheets are discharged on the plural trays serving as the discharge units 12 and 19 separately. One example of the present exemplary embodiment has a layout such that the third path 314 discharges the sheet after the sheet passes below the sheet supply unit 1 to the side opposite to the recording processing unit 4 and the drying unit 8 across the sheet supply unit 1.

As described above, the units from the sheet supply unit 1 to the drying unit 8 are sequentially provided on the first path 310. The portion ahead of the drying unit 8 is branched to the second path 312 and the third path 314, wherein the reversing unit 9 is provided on the second path 312, and the portion ahead of the reversing unit 9 joins the first path 310. The discharge unit 12 is provided at the terminal of the third path 314.

The control unit 13 controls each unit of the whole recording apparatus. The control unit 13 includes a controller 320 having various control units, an external interface 205, and an operation unit 15 through which the user performs an input operation and an output operation. The operation of the recording apparatus is controlled based on the instruction from the controller 320 or from the host apparatus 16 such as a host computer connected to the controller 320 through the external interface 205.

Figure 2:
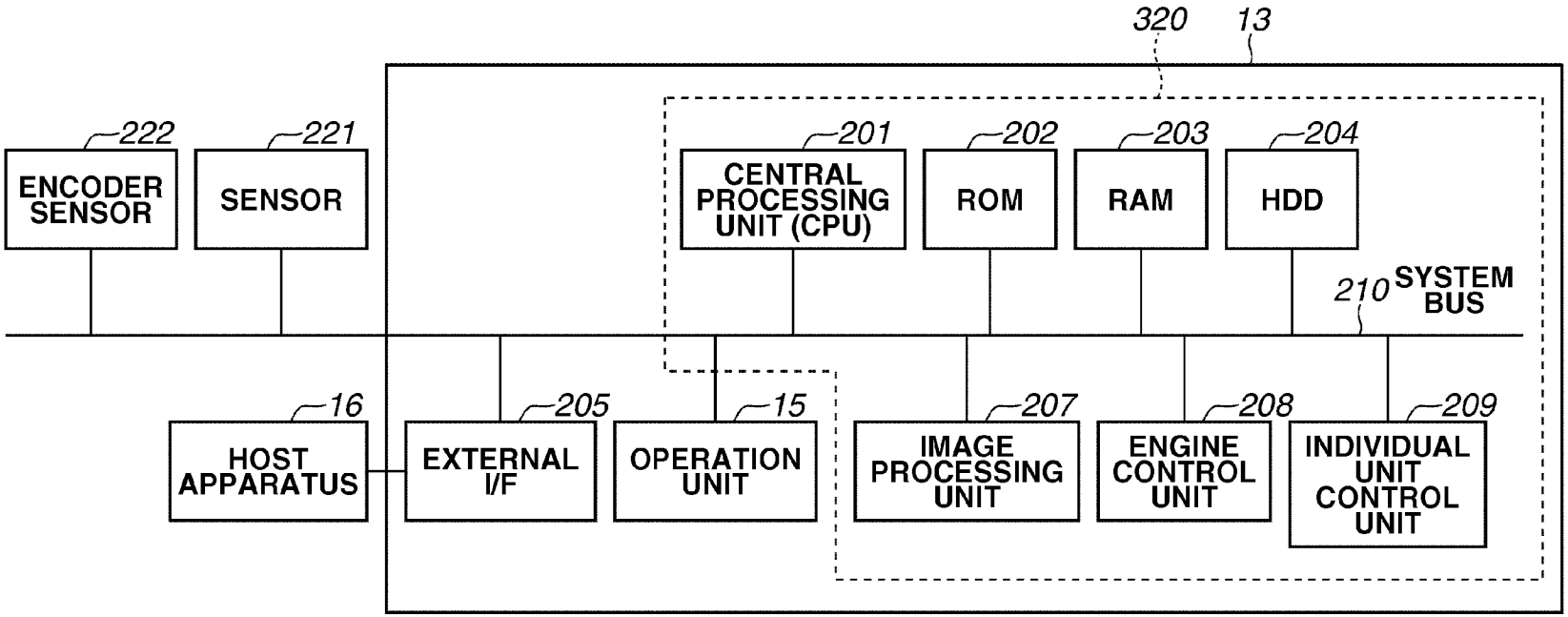
FIG. 2 is a block diagram illustrating a control unit of the recording apparatus.

FIG. 2 is a block diagram illustrating a conception of the control unit 13. The controller 320 included in the control unit 13 includes a central processing unit (CPU) 201, a read-only memory (ROM) 202, a random access memory (RAM) 203, a hard disk drive (HDD) 204, an image processing unit 207, an engine control unit 208, and an individual unit control unit 209.

The CPU 201 integrally controls the operation of the respective units of the recording apparatus. The ROM 202 stores a program to be executed by the CPU 201 and fixed data necessary for various operations of the recording apparatus. The RAM 203 is used as a work area of the CPU 201 or a temporal storage area of various received data. The RAM 203 also stores various setting data. The HDD 204 can store and read out a program to be executed by the CPU 201, print data, and setting information necessary for various operations of the recording apparatus.

The operation unit 15 is an input/output interface for a user, and includes an input unit such as a hard key or a touch panel, and an output unit such as a display for presenting information or a sound generator. For a unit of which a high-speed data processing is required, a dedicated processing unit is provided.

The image processing unit 207 processes an image of recording data handled in the recording apparatus. It converts information of a color space of the input recording data (image data), e.g., a color space of YcbCr, into information of standard RGB color space (e.g., sRGB pigment system). Various image processing such as a resolution conversion, image analysis, or image correction are executed to the image data, as required. The recording data obtained through these image processes is stored in the RAM 203 or the HDD 204.

The engine control unit 208 performs drive controls of the head 14 of the recording processing unit 4 according to the print data based on the control command received from the CPU 201 or the like. The engine control unit 208 also controls the conveyance mechanism 304 in each unit in the recording apparatus.

The individual unit control unit 209 is a sub-controller for individually controlling each of the sheet supply unit 1, the de-curl unit 2, the skew correction unit 3, the detection unit 5, the cutter unit 6, the information recording unit 7, the drying unit 8, the reversing unit 9, the discharge conveyance unit 10, the sorter unit 11, and the discharge unit 12. The individual unit control unit 209 controls the operation of each of the units based on the instruction from the CPU 201.

The external interface 205 is an interface (I/F) for connecting the controller to the host apparatus 16, and it is a local I/F or a network I/F. The each component constituting the control unit 13 is connected each other via a system bus 210.

A sheet sensor 221 detects a jam of the cut sheet in the conveyance path. The plural sheet sensors 221 are provided on each conveyance path at predetermined intervals. The control unit 13 determines whether the jamming occurs, based on whether the sheet sensor 221 detects the leading edge or the trailing end of the cut sheet at a predetermined timing during the conveyance of the cut sheet. An encoder sensor 222 reads plural marks formed on an encoder wheel 222*a* that rotates in synchronism with the conveyance rollers in each conveyance mechanism 304. The conveying speed or the conveying distance can be detected using an interval at which the encoder sensor 222 reads the marks, or using the count. The jamming is determined when it is detected that the encoder wheel 222*a* stops. The sheet sensor 221, the encoder wheel 222*a*, the encoder sensor 222, and the control unit 13 constitute a detection unit.

The host apparatus 16 is an apparatus serving as a supplying source of image data for causing the recording apparatus to perform the recording operation. The host apparatus 16 may be a general-purpose or dedicated computer, or a dedicated imaging device such as an image capture, a digital camera, or a photo storage having an image reader unit. When the host apparatus 16 is a computer, an operating system (OS), application software for generating image data, a printer driver for a printing apparatus, and the like are installed into a storage apparatus included in the computer. It is not essential that the all of the processes described above are realized by software, but a part or all of the processes may be realized by hardware.

A basic operation during the printing will next be described. The printing operation is different between the one-sided printing mode and a two-sided printing mode, so that each mode is separately described.

Firstly, the one-sided printing mode will be described. The continuous sheet is fed from the sheet supply unit 1, and subjected to the processes at the de-curl unit 2 and the skew correction unit 3. Then, an image is recorded on a front surface (first surface) at the recording processing unit 4. A unit image is sequentially recorded on a predetermined sheet unit part in the conveying direction of the long-sized continuous sheet, wherein the plural unit images are formed. The continuous sheet on which the recording operation is performed passes through the detection unit 5, and is cut at the cutter unit 6 in a sheet unit to become a cut sheet. Print information is recorded on the back surface of the cut sheet at the information recording unit 7 as required. Thereafter, the cut sheets are conveyed one by one to the drying unit 8 to be dried. Then, the cut sheets pass through the discharge conveying unit 10, are sorted by the sorter unit 11, and discharged and stacked one by one on the discharge unit 12. As described above, in the one-sided printing mode, the sheet passes through the first path 310 and the third path 314, but does not pass through the second path 312.

On the other hand, the continuous sheet, which is cut and separated at the cutter unit 6, and left at the recording processing unit 4, is fed back to the sheet supply unit 1, and taken up by the roll R1 or R2. When the sheet is fed back, it is preferable that the de-curl force at the de-curl unit 2 is adjusted to become smaller, and at the same time the head 14 is retreated from the sheet.

Next, the two-sided printing mode will be described. The operation of recording an image on the front surface (first surface) of the continuous sheet, more correctly, the operation at each unit from the sheet supply unit 1 to the detection unit 5, is the same as that in the one-sided printing mode. The continuous sheet is conveyed to the drying unit 8 as it is, without being cut to separate into sheet units at the cutter unit 6. After the ink on the front surface is dried at the drying unit 8, the continuous sheet is guided not to the third path 314 at the side of the discharge conveying unit 10 but to the second path 312 at the side of the reversing unit 9. On the second path 312, the continuous sheet is taken up by the take-up rotating member, which rotates in the forward direction (in the counterclockwise direction in the figure), at the reversing unit 9.

When the scheduled recording onto the front surface of the sheet is all completed at the recording processing unit 4, the continuous sheet is cut at the cutter unit 6, thereby being separated into one long continuous sheet including plural unit images, i.e., plural sheet units. Until the trailing edge (cut position) of the cut and separated continuous sheet is taken up by the reversing unit 9 via the drying unit 8 until completion of the taking-up.

On the other hand, in synchronism with the take-up by the reversing unit 9, the continuous sheet left at the upstream side (at the side of the recording processing unit 4) from the cut position in the conveying direction is fed back to the sheet supply unit 1 and taken up by the roll R1 or R2 in order that the leading edge (cut position) of the continuous sheet does not remain at the de-curl unit 2. This feed-back process (back feed) prevents collision with the sheet fed from the reversing unit 9 to the recording processing unit 4 during the back-surface recording sequence described below. During the back feed, it is preferable that the de-curl force is adjusted to decrease at the de-curl unit 2 and at the same time the head 14 is retracted from the sheet. After the above described front-surface recording sequence, the sequence is switched to the back-surface recording sequence.

During the back-surface recording sequence, the take-up rotating member at the reversing unit 9 rotates in the reverse direction (in the clockwise direction in the figure) to the take-up direction. The continuous sheet that is taken up is fed into the de-curl unit 2 along the path indicated by a broken line in FIG. 1, and then, passes through the first path 310 same as that during the front-surface recording. The trailing end of the continuous sheet at the time of the take-up, i.e., the cut portion, becomes the leading edge of the sheet when the sheet is fed out. The de-curl unit 2 corrects the curl applied at the take-up rotating member 9. Specifically, the de-curl unit 2 is provided between the sheet supply unit 1 and the recording processing unit 4 on the first path 310 and between the reversing unit 9 and the recording processing unit 4 on the second path 312, and on both paths, serves as a de-curl unit.

The reversed continuous sheet is fed to the recording processing unit 4 through the skew correction unit 3, whereby the recording is performed on the back surface of the continuous sheet. The recorded continuous sheet passes through the detection unit 5, and is cut off in a predetermined unit length, which is set beforehand, at the cutter unit 6 to become a cut sheet. Since the recording is performed on both surfaces of the cut sheet, it is unnecessary to record at the information recording unit 7. However, any information may be recorded at this unit. The cut sheet is conveyed one by one to the drying unit 8, sorted at the sorter unit 11 through the discharge conveying unit 10, and discharged and stacked successively onto the discharge unit 12 that is the sorting destination. When the recording is performed on both surfaces of the sheet as described above, the sheet passes through the first path 310, the second path 312, the first path 310, and the third path 314 in this order.

Figure 3A:
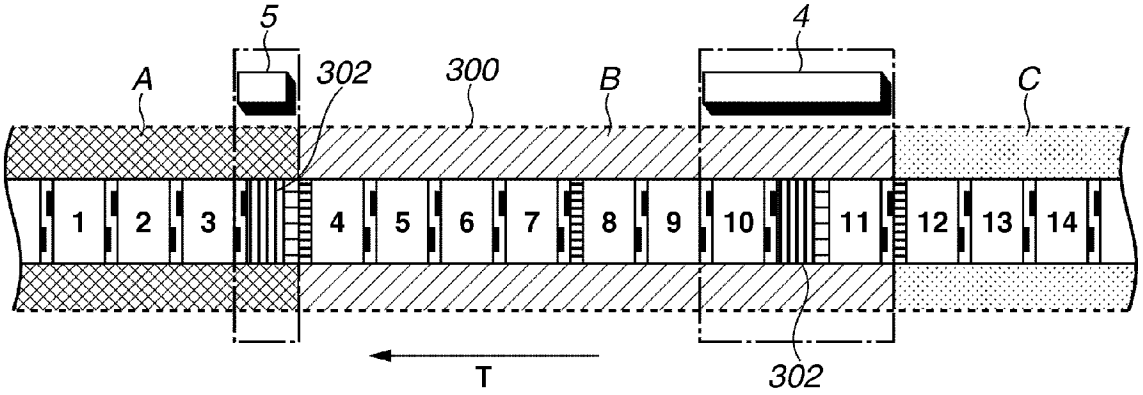
FIGS. 3A and 3B are views for describing a problem in a conventional apparatus.
Figure 3B:
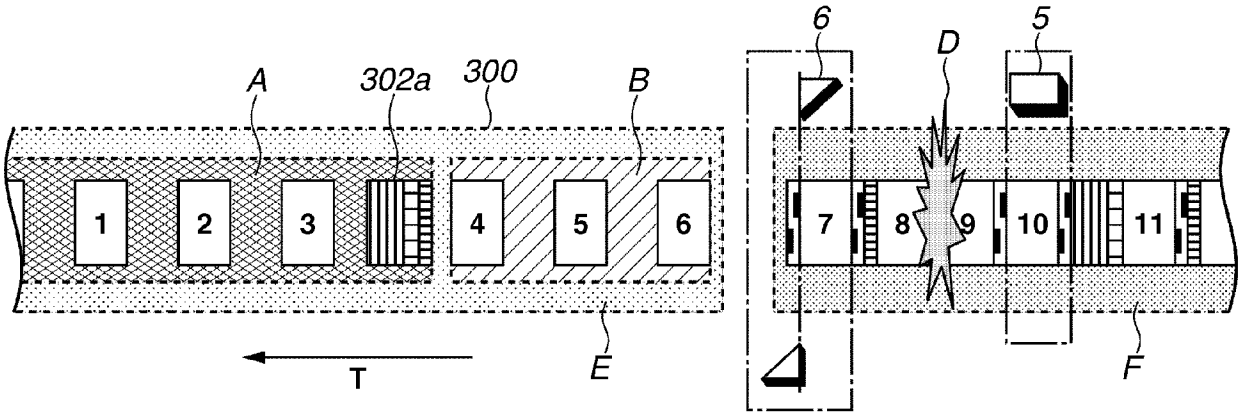

In the present exemplary embodiment, the detection unit 5 is mounted at the downstream side from the recording processing unit 4, which performs the recording operation to the continuous sheet 300, in the sheet conveying direction T as illustrated in FIG. 3A. The cutter unit that cuts and separates the continuous sheet to form the cut sheet is provided at the downstream side from the detection unit 5 in the sheet conveying direction T. The recording processing unit 4 prints the maintenance pattern 302 at an arbitrary position of the continuous sheet 300 during the continuous recording operation. Then, the sheet 300 is conveyed, and the detection unit 5 that checks the recording state of the maintenance pattern 302 reads the maintenance pattern 302 to determine whether the state of the image recorded on the continuous sheet 300 located at the downstream side from the maintenance pattern 302 is satisfactory. In FIGS. 3A and 3B, a region of the sheet where an image group determined to have a satisfactory image state is recorded is specified as A, a region of the sheet recording an image group whose printed state is undetermined is specified as B, and a region of the sheet recording an image group that has not yet been printed is specified as C.

When the conveyance failure of the sheet occurs during the recording operation in the recording apparatus that performs the recording operation to the continuous sheet, the issue is how to carry out the subsequent processes. When the sheet conveyance failure (paper jamming) occurs on the conveyance path at the upstream side from the cutter unit 6 in the conveying direction T, the continuous sheet is cut and separated at the cutter unit 6 to form the cut sheet. Therefore, the cut sheet located at the downstream side from the cutter unit 6 in the sheet conveying direction T can continue to be conveyed to be discharged.

However, the state of the image recorded at the upstream side from the maintenance pattern 302*a*, whose recording state is previously checked, is not checked whether the image is satisfactory at the point when the conveyance failure D is detected. Therefore, it cannot be determined whether the recording state thereof is satisfactory. Accordingly, the sheet at the downstream side from the cutter unit 6, i.e., the cut sheet that can continue to be conveyed, can include an undetermined portion B where it cannot be determined whether the printed state is satisfactory or unsatisfactory. In FIG. 3B, the range where the conveyance failure D does not affect the operation of the apparatus is specified as E, and the range where the conveyance failure D affects the operation of the apparatus is specified as F.

When the conveyance of the cut sheet, which can be conveyed, is continued after the occurrence of the conveyance failure, and all of the cut sheets are discharged on the same discharge unit, the cut sheets in which the recording state is determined to be satisfactory and the cut sheets in which the recording state is undetermined are coexistent.

In the present exemplary embodiment, a control is performed to avoid the situation described above.

Figure 4:
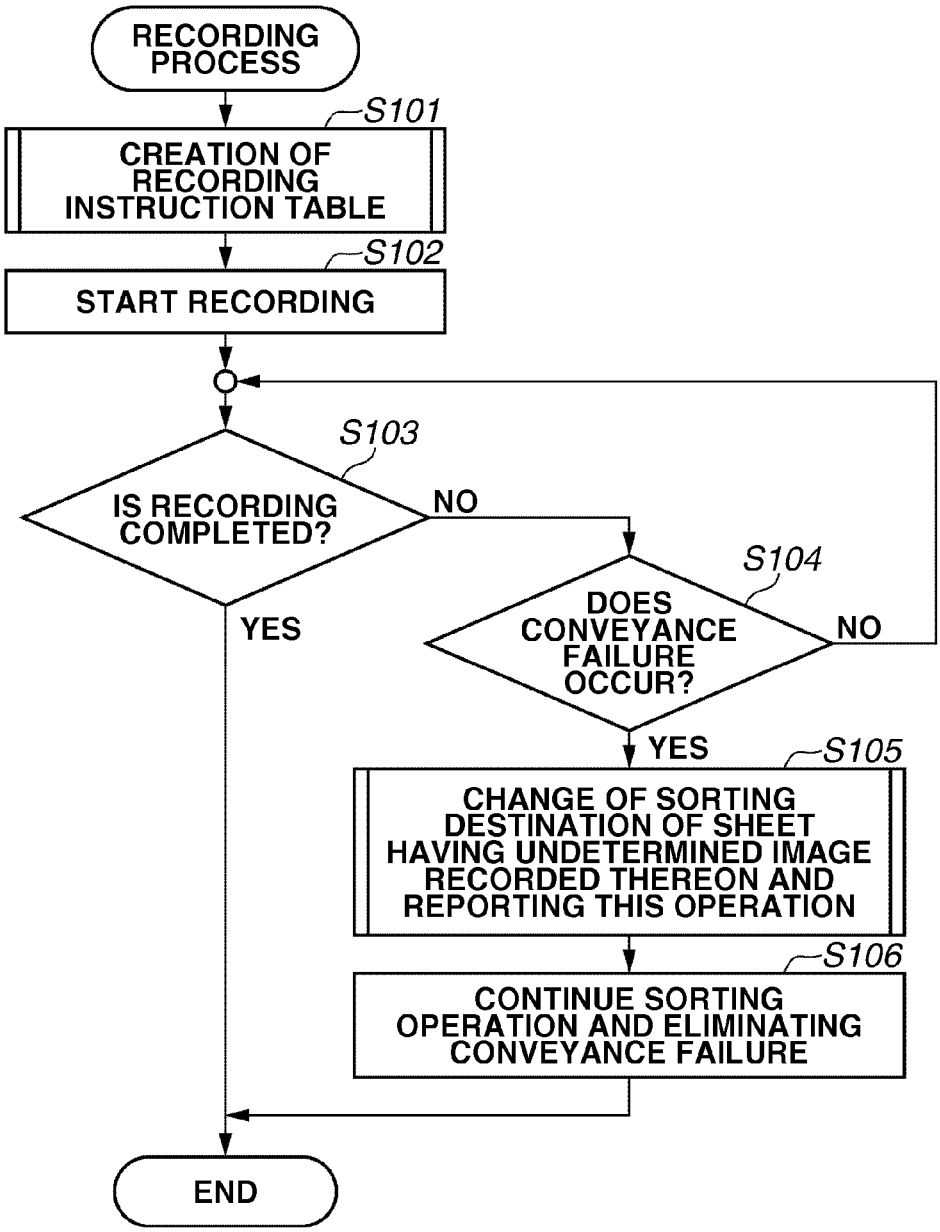
FIG. 4 is a flowchart illustrating a whole sequence of a recording operation.

FIG. 4 is a flowchart illustrating an overall sequence of the printing operation controlled by the control unit 13. In step S101, an initial recording instruction table is created on a memory based on the recording instruction. The print instruction table is for sequentially recording the unit image and the maintenance pattern in a predetermined order. The detail of the recording instruction table will be described below.

In step S102, the unit image and the maintenance pattern are sequentially recorded onto the continuous sheet in a predetermined order according to the created recording instruction table. Although not illustrated in FIG. 4, when the maintenance pattern is recorded, the recording state thereof is checked using the detection unit 5. In the case of the one-sided recording mode or the back-surface (second-surface) recording sequence in the two-sided recording mode, the continuous sheet, on which the recording operation has already been performed, is cut and separated at the cutter unit 6 to form the cut sheet. The cut sheet is discharged onto the desired sorting destination. In the case of the front-surface (first-surface) recording sequence in the two-sided recording mode, the sheet, on which the recording operation has already been performed, is taken up by the reversing unit 9, whereby the sheet is reversed. When the recording state of the maintenance pattern is determined to be satisfactory at the detection unit 5, the state of the nozzle of the head can also be determined to be satisfactory, whereby the recording state of the unit image at the downstream side from the maintenance pattern can be presumed to be satisfactory similar to the maintenance pattern. Accordingly, the printed unit image is conveyed to the desired discharge unit 12 or the reversing unit 9.

When the printed state of the maintenance pattern is determined to be poor by the detection unit 5, it can be presumed that the portion having the poor recording state exists in the image located at the downstream side from the maintenance pattern and up to the preceding maintenance pattern. Accordingly, in the one-sided recording mode or in the back-surface (second-surface) recording sequence in the two-sided recording mode, the unit sheet (cut sheet) that is determined to have the poor recording state is discharged to the trash box 18. In the front-surface (first-surface) recording sequence in the two-sided recording mode, the formation of the image within the range that is determined to have the poor recording state is stopped, and the information of the image whose formation is stopped is re-inserted at the end of the print instruction table. The range (sheet unit) determined to be poor is used as a blank space or the region where the maintenance pattern is printed at the time of the back-surface (second-surface) recording sequence in the two-sided recording mode, and after being cut, it is discharged into the trash box 18.

Although not illustrated in FIG. 4, when the recording state of the maintenance pattern is determined by the detection unit 5, the item of the recording state in the recording instruction table is updated from the undetermined state to the determined state.

In step S103, it is determined whether the recording designated by the recording instruction table is all completed (YES) or not (NO). If the result of the determination is YES, the sequence ends. If the result of the determination is NO, the processing proceeds to step S104.

In step S104, whether the conveyance failure such as a paper jam occurs (YES) or not (NO) is detected by the detection unit. If the result of the determination is YES, the processing proceeds to step S105. If the result of the determination is NO, the processing returns to step S103 to repeat the recording. In the case of the cut sheet, the conveyance failure in all conveyance paths is monitored, as needed, with the use of the sheet sensor during the recording operation. The structure of the detection unit may be a general one. For example, after it becomes ON in a short period, the sheet sensor may determine the conveyance failure occurs when ON-signal is continued even when the sheet is supposed to pass, and the signal of the sensor detecting the presence of the sheet should become OFF according to the control state of the driving system in the conveyance paths. In the case of the continuous sheet, the conveyance failure in all conveyance paths is monitored, as needed, during the recording operation using a rotary encoder connected to each conveyance roller. The configuration of the detection unit may be the general one. For example, the detection unit may monitor the rotation amount of each of the conveyance rollers, and determine the conveyance failure occurs between the most downstream conveyance roller that can rotate in a predetermined amount and the most upstream conveyance roller that cannot rotate in a predetermined amount, when allowing each of the conveyance rollers to rotate in a predetermined amount.

In step S105, the sorting destination of the cut sheet recording the undetermined image, whose recording state is undetermined is changed, and the notification process to the user is executed. The detail of the change of the sorting destination of the cut sheet recording the undetermined image, whose recording state is undetermined, and the notification process to the user will be described below. In step S106, the sorting operation is continued within the range in which the conveyance failure does not affect the operation of the apparatus, and the operation of eliminating the conveyance failure is executed. When the conveyance failure occurs at the upstream side from the cutter unit 6 during the one-sided recording mode or during the back-surface (second-surface) recording sequence in the two-sided recording mode, the sorting operation of the cut sheets at the downstream side from the cutter unit 6 is continued. After the sorting operation is completed, a conveyance failure error is notified to the user. The conveyance failure is resolved by the user manually. The user removes the portion where the paper jam occurs to return the apparatus into the state before the feed of the sheet (idle state). When the conveyance failure occurs at the upstream side from the cutter unit 6 during the front-surface (first-surface) recording sequence in the two-sided recording mode, the continuous sheet is cut and its conveyance is stopped, and only the sheets at the downstream side from the cutter unit 6 are conveyed to the reversing unit. After the conveyance to the reversing unit is completed, the conveyance failure error is notified to the user. The conveyance failure is resolved by the user manually. The user removes the portion where the paper jam occurs to return the apparatus into the state before the feed of the sheet (idle state). After the conveyance failure is resolved, the back-surface (second-surface) recording sequence in the two-sided printing mode is carried out as to the sheet that is reversed, i.e., the sheet conveyed to the reversing unit. The sheet, having an image formed thereon, at the downstream side from the cutter unit 6 is discharged onto the desired sorting destination or onto the dedicated tray 19 according to the item of the discharge unit as the sorting destination in the print instruction table.

Figure 5:
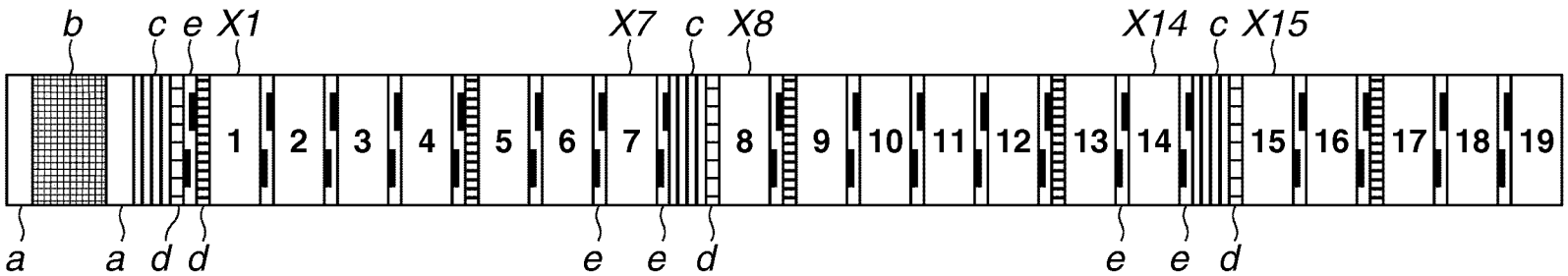
FIG. 5 is a schematic view for describing an internal structure of a recording instruction table.

FIG. 5 is a schematic view illustrating an internal structure of the recording instruction table. The recording instruction table holds data of a table number, a type of the recording pattern, a number of recording lines (corresponding to the length of the recording in the conveying direction), the discharge unit serving as the sorting destination (tray 1, tray 2, . . . , trash box), and the recording state (determined, undetermined). The recording instruction table is stored in a memory. The all recording state remains "undetermined" before the start of the recording, and after the detection unit 5 determines whether the recorded image is satisfactory, it is changed to "determined".

FIG. 5 schematically illustrates the state in which the unit image and the maintenance pattern are sequentially recorded onto the continuous sheet in a predetermined order according to the recording instruction table. FIG. 5 illustrates the arrangement order of the initial recording instruction table created in step S101. In the figure, the type of the recording pattern includes a blank space, a maintenance pattern (non-ejection monitoring pattern, preliminary ejection pattern, etc.), and cut mark, in addition to the unit image. In the example of FIG. 5, a blank space a, a maintenance pattern b, a blank space a, a non-ejection monitoring pattern c, a preliminary ejection pattern d, a cut mark e, a unit image× 1, . . . , the cut mark e, a unit image×7, and the cut mark e are arranged in this order from the leading edge of the sheet (from the left in the figure). Then, the non-ejection monitoring pattern c, the preliminary ejection pattern d, a unit image× 8, . . . , the cut mark e, a unit image×14, the cut mark e, the non-ejection monitoring pattern c, the preliminary ejection pattern d, and a unit image×15, . . . are arranged afterward. Basically, the maintenance pattern is formed in a predetermined frequency. The predetermined frequency is suitably set according to the size of the unit image (number of recording lines) in the conveying direction. In this example, the preliminary ejection operation is performed every time four unit images or a set including three unit images and one non-ejection monitoring pattern are recorded to repeatedly form the preliminary ejection pattern, according to the initial recording instruction table as illustrated in FIG. 5.

Figure 7:
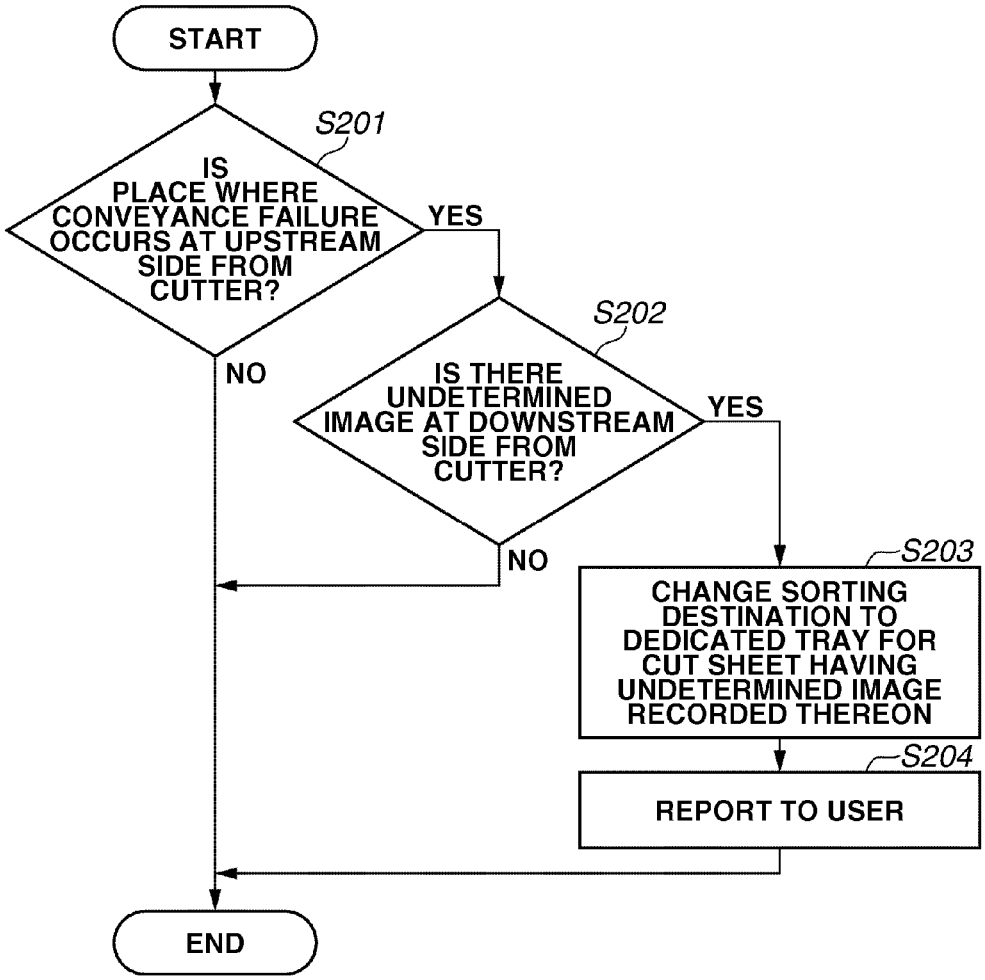
FIG. 7 is a flowchart describing a change of a sorting destination of an undetermined image and a notification process to a user after the occurrence of a conveyance failure.

FIG. 7 is a flowchart illustrating a flow of the change of the sorting destination of the sheet having the undetermined image recorded thereon and the notification process to the user, after the occurrence of the conveyance failure. In step S201, it is determined whether the point where the conveyance failure occurs is upstream side from the cutter unit 6 (YES) or not (NO). If the result of the determination is YES, the processing proceeds to step S202. If the result of the determination is NO, the processing ends.

In step S202, it is determined whether the unit sheet whose recording state is undetermined is present at the downstream side from the cutter unit 6 (YES) or not (NO). If the result of the determination is YES, the processing proceeds to step S203. If the result of the determination is NO, the processing ends. The number of the recording lines from the leading edge of the continuous sheet is counted, and based on the number of the recording lines, where the respective unit images are present on the conveyance path can be estimated. Thus, the unit image present at the cutter unit 6 and the unit image present at the downstream side from the cutter unit 6 can be specified.

The processing proceeds to step S203 when the conveyance failure of the continuous sheet is detected at the upstream side from the position where the cutter is provided is detected by the detection unit, and the maintenance pattern checked immediately before the point of detecting the conveyance failure by the detection unit is present at the downstream side from the cutter unit 6 at the point of detecting the conveyance failure. In step S203, the item of the sorting destination in the print instruction table is updated to the dedicated tray 19 from the initial sorting destination for only the unit image whose recording state is undetermined. It is desirable that the cut sheet recording the unit image whose recording state is undetermined, is discharged onto the dedicated tray 19 (i.e., the discharge unit) as the sorting destination, to distinguish this cut sheet from the one having the determined image recorded thereon. However, it is not necessarily discharged onto the dedicated tray 19. If there is the discharge unit (free tray) to which the sheet is not scheduled to be discharged, this tray may be selected as the discharge unit that is the sorting destination. As described above, the sorter unit is controlled such that the sheet unit present between the maintenance pattern previously checked and the position of the cutter is discharged onto the discharge unit which is different from the discharge unit to which the other sheet unit is discharged.

FIG. 8 is a view for describing how the recording instruction table is updated by the changing process of the sorting destination for the undetermined image, as an example, in a case where the conveyance failure occurs at the upstream side from the cutter unit 6.

For example, it is supposed that a paper jam D occurs at the position of the sheet corresponding to a table number 43. Since the paper jam D might affect the operation of the apparatus, the units at the upstream side from the cutter unit 6 cannot keep on operating. In the example of FIG. 8, the cutter of the cutter unit 6 is present between the position of the sheet corresponding to the table number 31 and the position of the sheet corresponding to the table number 32. Therefore, the portion of the sheet recording the image after the table number 32 cannot be conveyed. On the other hand, the operation of each of the units at the downstream side from the cutter unit 6 can be continued, since the paper jam D does not affect the operation, if the continuous sheet is cut and separated at the cutter unit 6. Therefore, the sheet recording the image before the table number 31 can be conveyed. However, the detection unit 5 cannot convey the sheet of the image portion after the table number 32 when it makes a last check of the non-ejection monitoring pattern d on the table number 23, so that it cannot check the non-ejection monitoring pattern don the table number 41, which is to be checked next. Therefore, it cannot be determined whether the recording state of the image between the table number 23 and the table number 40 is satisfactory or poor. In view of this, the information of the sorting destination in the recording instruction table is updated to the dedicated tray 19 for the unit image whose recording state is undetermined and for the image within the range in which the conveying operation can be continued, i.e., the cut sheet on which the unit image from the table number 24 to the table number 31 is recorded. For example, the data at the table numbers 25, 28, and 30 are updated to the data of symbols f, g, and h in FIG. 8. When the conveyance failure occurs during the front-surface (first-surface) sequence in the two-sided printing mode, the information of the sorting destination in the recording instruction table is updated to the dedicated tray 19, and only the sheet at the downstream side from the cutter unit 6 is conveyed to the reversing unit. The portion where the jam occurs is removed, and the back-surface (second-surface) sequence is executed to the sheet conveyed to the reversing unit. Thereafter, the cut sheet cut and separated by the cutter unit 6 is discharged to the desired sorting destination or to the dedicated tray 19 according to the item of the discharge unit serving as the sorting destination in the printing instruction table.

In step S204, the generation of the unit image whose printed state is undetermined is notified to a user by a notification mechanism. The notification mechanism may be the display unit of the operation unit 15, or may be the one making an alarm sound or a speech. It is desirable that the characters on the display or the sound additionally indicate a table number of the unit image recorded on the cut sheet, which is discharged onto the dedicated tray 19. If the dedicated tray 19 is provided only for the purpose of discharging the cut sheet recording the image whose recording state is undetermined, a user can be notified that the image whose recording state is undetermined is generated when the discharge is performed on the dedicated tray 19. Therefore, it is not always necessary to make a notification to the user, and only the process of discharging the cut sheet onto the dedicated tray 19 may be performed.

According to the exemplary embodiment described above, a cut sheet recording a unit image whose recording state is determined and a cut sheet recording a unit image whose recording state is undetermined are separately discharged, whereby a user can easily confirm the recording state of the undetermined image. If it is notified to the user to which discharge unit the cut sheet recording the undetermined image is discharged, the user easily knows the discharge unit to which the undetermined image is discharged, which should visually be confirmed. As described above, according to the present invention, the cut sheet recording the image whose printed state is undetermined cannot be mixed with the cut sheet recording the image whose printed state is determined.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-194496 filed Aug. 31, 2010, which is hereby incorporated by reference herein in its entirety.

What is claimed is:

1. A recording apparatus comprising:

a conveying unit configured to convey a continuous sheet;

a recording processing unit configured to eject liquid to the continuous sheet to record an image and plural maintenance patterns;

a recording detection unit provided downstream of the recording processing unit in a conveying direction of the continuous sheet and configured to check the plural maintenance patterns recorded on the continuous sheet;

a cutter unit provided downstream of the recording processing unit in the conveying direction and configured to use a cutter to cut the continuous sheet into sheet units to form a cut sheet;

plural discharge units configured to selectively receive the cut sheet;

a discharge unit changeover unit configured to select one discharge unit of the plural discharge units such that the cut sheet is discharged to the selected one discharge unit of the plural discharge units;

a conveyance failure detection unit configured to detect a conveyance failure of the continuous sheet; and a control unit configured to control the discharge unit changeover unit such that, when a conveyance failure of the continuous sheet is detected by the conveyance failure detection unit upstream of a position where the cutter is provided, and a maintenance pattern previously checked by the recording detection unit is present downstream of the cutter when the conveyance failure is detected, a present sheet unit present between the maintenance pattern and the position of the cutter is discharged to a second discharge unit, wherein the second discharge unit is different from a first discharge unit used for a sheet unit other than the present sheet unit.

2. The recording apparatus according to claim 1, wherein the control unit holds data that links each of the sheet units of the continuous sheet and a result of whether a recording state of the image recorded onto each of the sheet units is determined by the recording detection unit to be satisfactory, and controls the discharge unit changeover unit based on the data.

3. The recording apparatus according to claim 2, wherein one discharge unit of the plural discharge units is designated as a discharge unit for only those sheet units whose recording state is determined to be unsatisfactory.

4. The recording apparatus according to claim 2, further comprising a notification mechanism configured to notify, in response to determining that a first sheet unit, whose recording state of an image recorded on the first sheet unit is determined by the recording detection unit to be unsatisfactory, is discharged, a user that the first sheet unit is discharged.

5. The recording apparatus according to claim 1, wherein the control unit counts a number of recording lines that have already been recorded by the recording processing unit, and, based on the number of counted recording lines, the control unit determines whether the maintenance pattern previously checked by the recording detection unit is present downstream of the cutter unit when the conveyance failure is detected.

6. The recording apparatus according to claim 1, wherein the continuous sheet includes sheet units for plural pages and wherein each sheet unit separated from the continuous sheet is a cut sheet formed by the cutter of the cutting unit and includes a unit image.

7. A control method for a recording apparatus, the control method comprising:

conveying a continuous sheet using a conveying unit;

ejecting liquid to the continuous sheet, using a recording processing unit, to record an image and plural maintenance patterns;

checking the plural maintenance patterns recorded on the continuous sheet using a recording detection unit provided downstream of the recording processing unit in a conveying direction of the continuous sheet;

cutting the continuous sheet into sheet units to form a cut sheet via a cutter unit using a cutter and provided downstream of the recording processing unit in the conveying direction;

selectively receiving the cut sheet in plural discharge units;

selecting one discharge unit of the plural discharge units, using a discharge unit changeover unit, such that the cut sheet is discharged to the selected one discharge unit of the plural discharge units;

detecting a conveyance failure of the continuous sheet using a conveyance failure detection unit; and controlling the discharge unit changeover unit, using a control unit, such that, when a conveyance failure of the continuous sheet is detected by the conveyance failure detection unit upstream of a position where the cutter is provided, and a maintenance pattern previously checked by the recording detection unit is present downstream of the cutter when the conveyance failure is detected, a present sheet unit present between the maintenance pattern and the position of the cutter is discharged to a second discharge unit, wherein the second discharge unit is different from a first discharge unit used for a sheet unit other than the present sheet unit.

8. A recording apparatus comprising:

a recording unit configured to record a plurality of images onto a continuous sheet conveyed;

a pattern check unit configured to check a maintenance pattern formed between two images of the plurality of images;

a cutter unit configured to cut the continuous sheet into sheets;

a conveyance failure detection unit configured to detect a conveyance failure of the continuous sheet;

a sort unit configured to sort the sheets into a discharge portion; and a control unit configured to control the sort unit, wherein, in a case where a conveyance failure of the continuous sheet is detected by the conveyance failure detection unit, the control unit controls the sort unit to sort sheets, which were located upstream of the maintenance pattern checked by the pattern check unit at a time of the conveyance failure, into a discharge portion that is different from a discharge portion into which sheets, which were located downstream of the maintenance pattern checked by the pattern check unit at the time of the conveyance failure, are sorted.

9. The recording apparatus according to claim 8, wherein, in a conveyance direction of the continuous sheet, the pattern check unit is provided downstream of the recording unit and the cutter unit is provided downstream of the pattern check unit.

10. The recording apparatus according to claim 8, wherein the control unit is further configured to control a recording head of the recording unit to record the maintenance pattern.

11. The recording apparatus according to claim 8, further comprising a notification unit configured to notify a user in a case where the sheets which were located downstream of the maintenance pattern and the sheets which were located upstream of the maintenance pattern are sorted by the sort unit.

12. A recording apparatus comprising:

a recording unit configured to record a plurality of images onto a continuous sheet conveyed;

a pattern check unit configured to check a maintenance pattern formed between two images of the plurality of images;

a cutter unit configured to cut the continuous sheet into sheets;

a conveyance failure detection unit configured to detect a conveyance failure of the continuous sheet;

a sort unit configured to sort the sheets into a plurality of discharge portions; and a control unit configured to control the sort unit, wherein, in a case where a conveyance failure of the continuous sheet is detected by the conveyance failure detection unit, the control unit controls the sort unit to sort sheets, which were located upstream of the maintenance pattern checked by the pattern check unit at a time of the conveyance failure, into one discharge portion of the plurality of discharge portions that is different from discharge portions into which sheets, which were located downstream of the maintenance pattern checked by the pattern check unit at the time of the conveyance failure, are sorted.

13. A recording apparatus comprising:

a recording unit configured to record a plurality of images on a continuous sheet conveyed;

a pattern check unit configured to check a check pattern formed on the continuous sheet;

a cutter unit configured to cut the continuous sheet into sheets;

a sort unit configured to sort the sheets; and a control unit configured to control the sort unit, wherein, in a case where a conveyance failure of the continuous sheet has occurred, the control unit controls the sort unit to sort sheets, which were located upstream of the check pattern checked by the pattern check unit at a time of conveyance failure, into a second discharge portion that is different from a first discharge portion into which sheets, which were located downstream of the check pattern checked by the pattern check unit at the time of the conveyance failure, are sorted.

14. The recording apparatus according claim 13, wherein the recording unit records the check pattern on the continuous sheet.

15. The recording apparatus according claim 13, wherein the cutter unit is provided downstream of the pattern check unit.

16. The recording apparatus according to claim 13, further comprising a notification unit configured to notify a user that the conveyance failure has occurred.

17. The recording apparatus according to claim 13, further comprising a conveyance failure detection unit configured to detect the conveyance failure of the continuous sheet.

18. The recording apparatus according to claim 17, wherein the recording unit records the check pattern on the continuous sheet.

19. A recording apparatus comprising:

a recording unit configured to record a plurality of images onto a continuous sheet conveyed;

a pattern check unit configured to check a check pattern formed on the continuous sheet;

a cutter unit configured to cut the continuous sheet into sheets;

a sort unit configured to sort the sheets;

a determination unit configured to determine whether a recording state of each of the sheets is satisfactory; and a control unit configured to control the sort unit, wherein, in a case where a conveyance failure of the continuous sheet has occurred, the control unit controls the sort unit to not sort sheets, which were located upstream of the check pattern checked by the pattern check unit at the time of the conveyance failure, into a discharge portion into which sheets determined by the determination unit to be satisfactory are sorted.

20. The recording apparatus according claim 19, wherein the cutter unit is provided downstream of the pattern check unit.

21. The recording apparatus according to claim 19, further comprising a notification unit configured to notify a user that the conveyance failure has occurred.

22. A conveying apparatus comprising:

a conveying unit configured to convey a continuous sheet on which a plurality of images are recorded;

a pattern check unit configured to check a check pattern formed on the continuous sheet;

a cutter unit configured to cut the continuous sheet into sheets;

a sort unit configured to sort the sheets; and a control unit configured to control the sort unit, wherein, in a case where a conveyance failure of the continuous sheet has occurred, the control unit controls the sort unit to sort sheets, which were located upstream of the check pattern checked by the pattern check unit at the time of the conveyance failure, into a discharge portion that is different from a discharge portion into which sheets, which were located downstream of the check pattern checked by the pattern check unit at the time of the conveyance failure, are sorted.

23. A conveying apparatus comprising:

a conveying unit configured to convey a continuous sheet on which a plurality of images are recorded;

a pattern check unit configured to check a check pattern formed on the continuous sheet;

a cutter unit configured to cut the continuous sheet into sheets;

a sort unit configured to sort the sheets;

a determination unit configured to determine whether a recording state of each of the sheets is satisfactory; and a control unit configured to control the sort unit, wherein, in a case where a conveyance failure of the continuous sheet has occurred, the control unit controls the sort unit to not sort sheets, which were located upstream of the check pattern checked by the pattern check unit at a time of the conveyance failure, into a discharge portion into which sheets determined by the determination unit to be satisfactory are sorted.

* * * * *